US005309839A

United States Patent [19]

Hartung et al.

[11] Patent Number: 5,309,839

[45] Date of Patent: May 10, 1994

[54] METHOD AND APPARATUS FOR FACILITATING THE PRINTING OF VERSO SIDES AND THE VARNISHING OF RECTO SIDES OF SHEETS

[75] Inventors: Georg Hartung, Seligenstadt; Michael Rother, Urberach, both of Fed. Rep. of Germany

[73] Assignee: MAN Roland Druckmaschinen AG, Fed. Rep. of Germany

[21] Appl. No.: 44,274

[22] Filed: Apr. 7, 1993

[30] Foreign Application Priority Data

Apr. 7, 1992 [DE] Fed. Rep. of Germany ..... 4211638

[51] Int. Cl.[5] ..... B41F 5/02; B05C 11/00; B05D 1/00

[52] U.S. Cl. ..... 101/483; 101/229; 101/231; 427/211; 427/288; 118/46

[58] Field of Search ..... 101/483, 229, 230, 231; 427/209, 210, 211, 288; 118/46

[56] References Cited

U.S. PATENT DOCUMENTS

| | | | |
|---|---|---|---|
| 2,898,851 | 8/1959 | Peyrebrune | 101/231 |
| 3,384,011 | 5/1968 | olza-Schünemann | 101/229 |
| 4,414,896 | 11/1983 | Fischer | 101/231 |
| 4,664,949 | 5/1987 | Greiner et al. | 101/229 |
| 4,967,660 | 11/1990 | Yamanari et al. | 101/229 |
| 5,103,730 | 4/1992 | Sarda | 101/425 |

FOREIGN PATENT DOCUMENTS

| | | | |
|---|---|---|---|
| 504639 | 7/1954 | Canada | 101/229 |
| 3015519A1 | 2/1981 | Fed. Rep. of Germany . | |
| 8028547 | 10/1981 | Fed. Rep. of Germany . | |
| 3248232C1 | 2/1984 | Fed. Rep. of Germany . | |

*Primary Examiner*—Eugene H. Eickholt

*Attorney, Agent, or Firm*—Leydig, Voit & Mayer, Ltd.

[57] ABSTRACT

Method and apparatus for the varnishing and printing of sheets in a printing machine. A feed drum incorporates a counterpressure surface to form a first nip with an impression cylinder. As sheets are fed to the impression cylinder and transported through the first nip, a constant pressure at the first nip consistently transfers ink to a verso side of each sheet. Arranged thereafter, a varnishing cylinder supplied with a quantity of varnish contacts the impression cylinder creating a second nip. As the sheet passes through the second nip, the recto side of the sheet is coated with the varnish. The impression cylinder thus receives a constant pressure for transferring ink to the sheet independent of the pressure provided by the varnishing cylinder. Accordingly, even a partial or intermittent varnishing of the recto sheet side has no adverse effect on print quality, and the sheet does not have to be transferred from the impression cylinder to a separate varnishing unit.

19 Claims, 3 Drawing Sheets

METHOD AND APPARATUS FOR FACILITATING THE PRINTING OF VERSO SIDES AND THE VARNISHING OF RECTO SIDES OF SHEETS

FIELD OF THE INVENTION

The invention relates generally to printing machines, and more particularly to a varnishing unit within a printing machine including a prior printing unit.

BACKGROUND OF THE INVENTION

Printed sheets are often varnished, or coated, to provide a smooth surface. In typical printing machines, this is performed by a conventional varnishing unit disposed after the printing units. When two-sided printing occurs wherein one side of the sheets is varnished after having been earlier printed, problems occur due to pressure from a subsequent printing operation on the opposite side destroying the smooth surface produced by the varnishing. Thus, it would appear to be desirable to print the verso side, i.e., perfect the sheet, before transferring the sheet to the varnishing unit for varnishing.

However, the well-known disadvantages of perfecting a sheet before transferring the sheet to a varnishing unit will be appreciated by those skilled in the art of printing. For example, the recently inked side of the sheet must contact some surface in the varnishing unit, generally another cylinder, so that varnish can be evenly applied to the other, previously printed, side. However, unless the ink is first allowed to dry, it will smear and accumulate on the surface it contacts, particularly if the surface is on a cylinder rotating at high speed. After the varnish is applied, the varnish must likewise be dried before stacking the sheets at a delivery unit. Thus, even if ink-smearing was sufficiently reduced by providing enough ink-drying time, this would lengthen the total drying time since first the ink would have to dry before the varnish could be applied and subsequently dried.

Accordingly, U.S. Pat. No. 4,664,949 (corresponding to German Patent No. DE 3,248,232) assigned to the present assignee solves these problems by simultaneously varnishing one already printed side of the sheet while printing the other. This is accomplished by pressing the varnishing cylinder against the impression cylinder, forming a nip between the cylinders such that as sheets pass through, the pressure enables the printing of one side while the other is varnished. As a result, both sides of the sheets dry while being carried to the delivery station, and there is no transferring of the sheet to another cylinder. However, since the ink-carrying rubber blanket or printing plate on the impression cylinder coincides with the varnishing blanket on the varnishing cylinder, the pressure can vary between the impression cylinder and the varnishing cylinder which results in inconsistent printing quality, particularly when instead of varnishing the entire sheet side, the sheet is only partially or intermittently varnished.

Partial varnishing is ordinarily accomplished by providing gaps, or intervals, between a number of separated varnishing blankets (or a single blanket having gaps or intervals therein) secured around the varnishing cylinder. The pressure between the varnishing cylinder and the impression cylinder fluctuates from a normal level to a reduced level as first a varnishing blanket and then an interval between blankets reaches the nip created by the varnishing and impression cylinders. These pressure fluctuations result in the inconsisent transferring of ink to the sheet in the aforementioned device.

OBJECTS AND SUMMARY OF THE INVENTION

Accordingly, it is an object of the present invention to provide a method and apparatus for consistently printing a verso printing side of a sheet and varnishing a printed recto side of a sheet. It is an related object to provide consistent print quality even while only partially or intermittently varnishing sheets.

Another object of the invention is to provide a method and apparatus as characterized above that creates a constant pressure for transferring ink to the verso side independent of the application of varnish to the recto side.

A further object of the invention is to provide a method and apparatus of the above kind that perfects printed sheets by printing on a verso side prior to varnishing the already printed recto side without removing the sheet from the impression cylinder to a separate varnishing unit.

Briefly, the invention provides a first counterpressure surface, preferably incorporated in the feed drum roller, in contact with the impression cylinder forming a first nip through which sheets are transported. As a result of constant pressure at the first nip, the ink is evenly transferred to the sheet on the verso printing side. At a later moment in time, but while the sheet still remains on the impression cylinder, a varnishing cylinder in contact with the impression cylinder creates a second nip whereby varnish is applied to the recto printing side. Since the amount of pressure enabling the transferring of the print is not regulated by the possibly varying pressure of the varnishing cylinder, the printing ink is consistently transferred to the verso printing side of the sheet regardless of the varnishing pattern established by the varnishing blanket or blankets on the varnishing cylinder. Nevertheless, the advantages obtained with simultaneous varnishing and printing are obtained since the varnish is applied only an instant after the printing is applied while the sheet is still on the impression cylinder, and thus transfer to a subsequent cylinder is unnecessary.

Other objects and advantages will become apparent from the following detailed description when taken in conjunction with drawings, in which:

Figure 1:
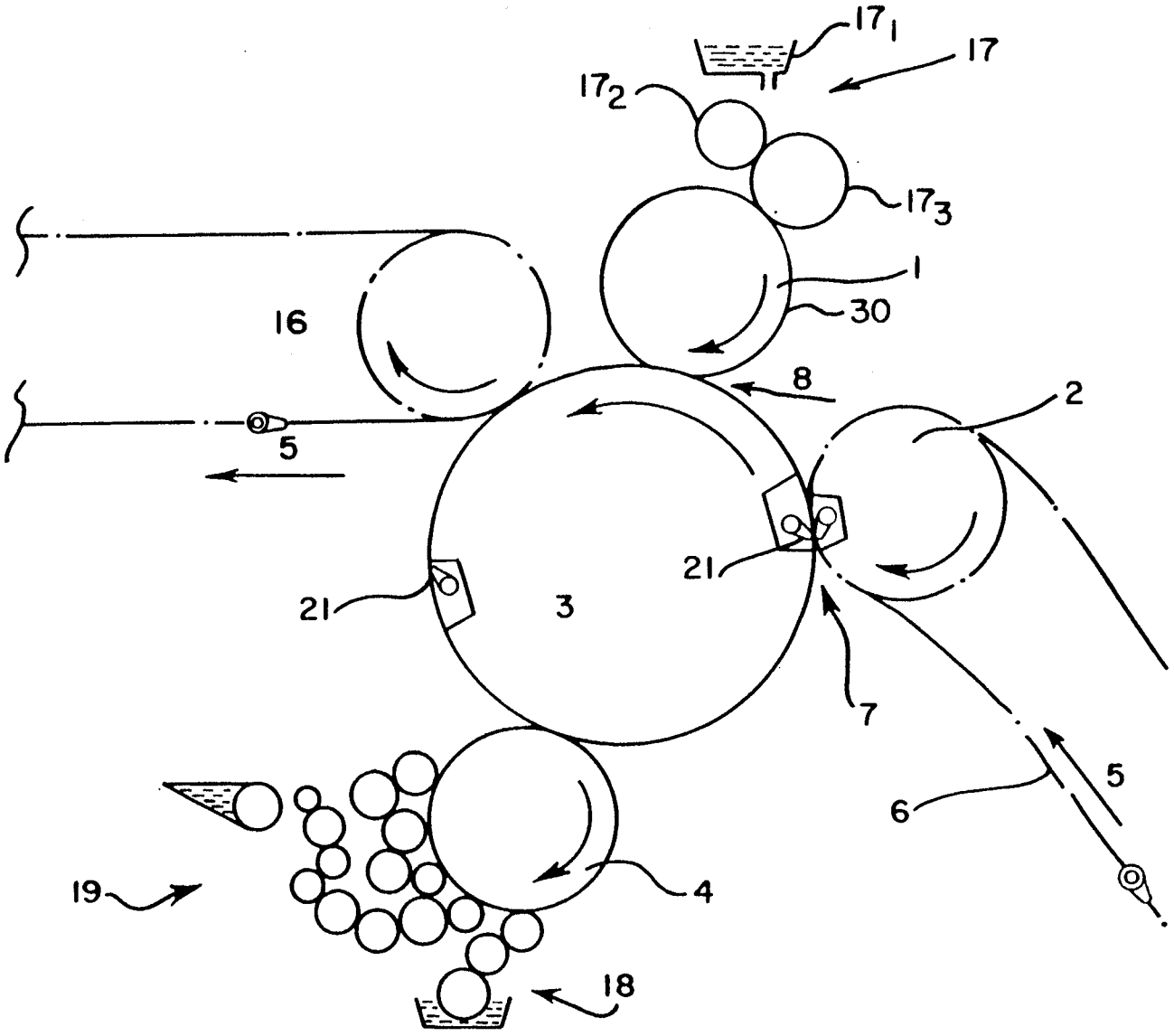
FIG. 1 is a diagrammatic view of the varnishing unit in relation to the first counterpressure cylinder incorporated in the feed drum according to the invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Turning to FIG. 1 of the drawings, there is shown a printing system wherein a feed drum 2 feeds a sheet 6 (already printed on the recto side) to an impression cylinder 3, i.e., in the direction indicated by directional arrow 5. Generally, the feed drum 2 is coupled to a conventional chain-and-carriage guide sheet transporting system coupled to a previous printing unit. The feed drum 2 transfers sheets (such as sheet 6) to the impression cylinder 3 in a conventional manner by utilizing a gripper means 21.

For printing on the verso side of sheets, an inking unit, preferably a plate cylinder 4 having a dampening system 18 and an inking system 19 inks the impression cylinder 3 for ultimately transferring ink to the verso printing side of the sheet in a conventional manner.

For varnishing the previously printed recto side of the sheet, a varnishing unit 17 is also provided and supplies a quantity of varnish from varnish reservoir $17_1$ to varnishing cylinder 1 via a varnishing feed roller $17_2$ in conjunction with a metering roller $17_3$. The varnishing cylinder 1 includes an outer varnishing blanket 30, such as a rubber blanket which may include gaps or intervals for partial or intermittent varnishing of sheets.

Figure 2:
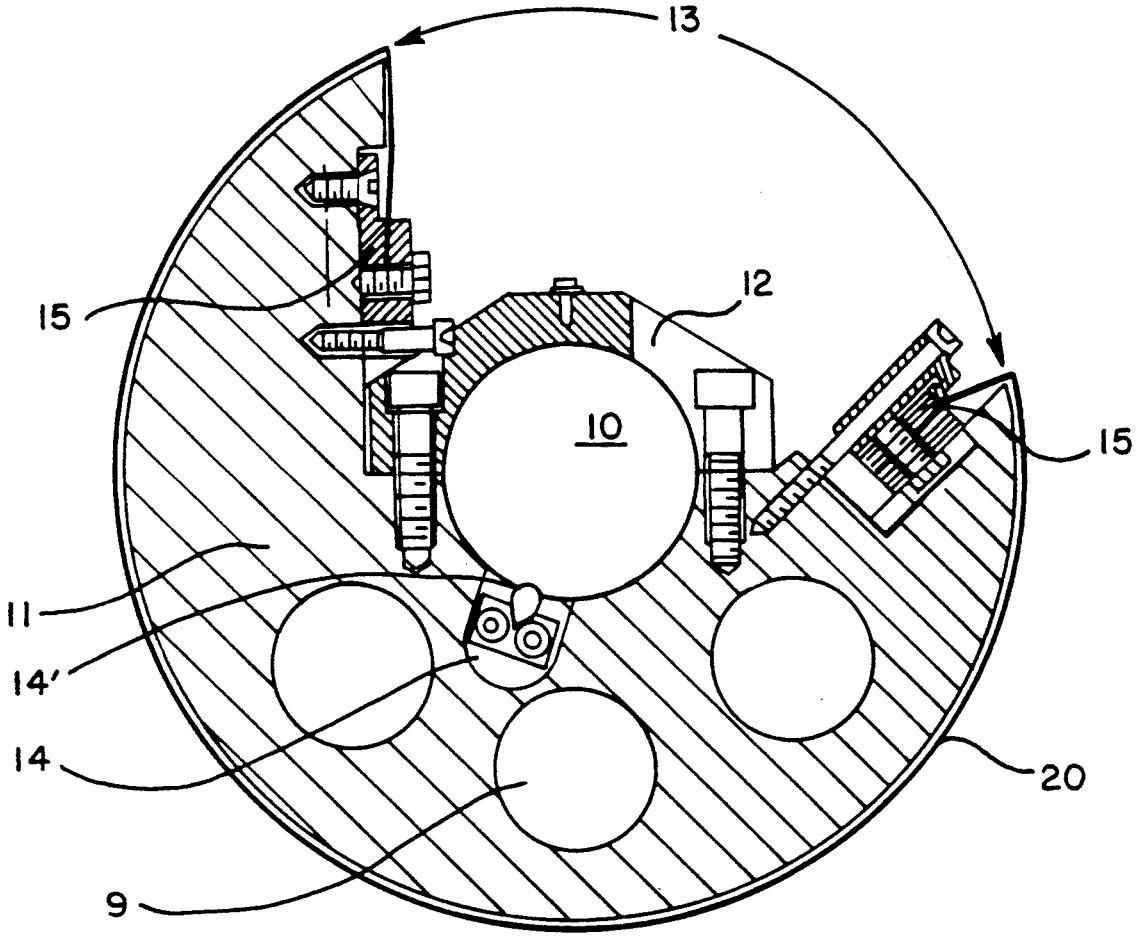
FIG. 2 is a cross-sectional view of a feed drum incorporating the counterpressure surface according to the invention.

In accordance with the invention, as shown in FIG. 2 the feed drum 2 includes a counterpressure section 11 which causes a counterpressure surface 20 of the feed drum 2 to press against the impression cylinder 3, thereby applying a constant pressure to the impression cylinder at a first nip 7 prior to the application of the varnish at the varnishing roller 17. The pressure supplied at the first nip 7 is constant causing the ink to be transferred to the verso printing side of the sheet 6 in a consistent manner.

The printing occurs on the verso sheet side prior to the varnishing of the already printed recto side of the sheet (as considered in the direction of sheet movement represented by directional arrow 5). Accordingly, even when only partially varnishing a sheet, varying pressure at a second nip 8, defined by the point of contact of outer varnishing blanket 30 of varnishing cylinder 1 and the impression cylinder 3, does not influence print quality since the print quality on the verso side is determined by the pressure at the first nip 7.

Figure 3:
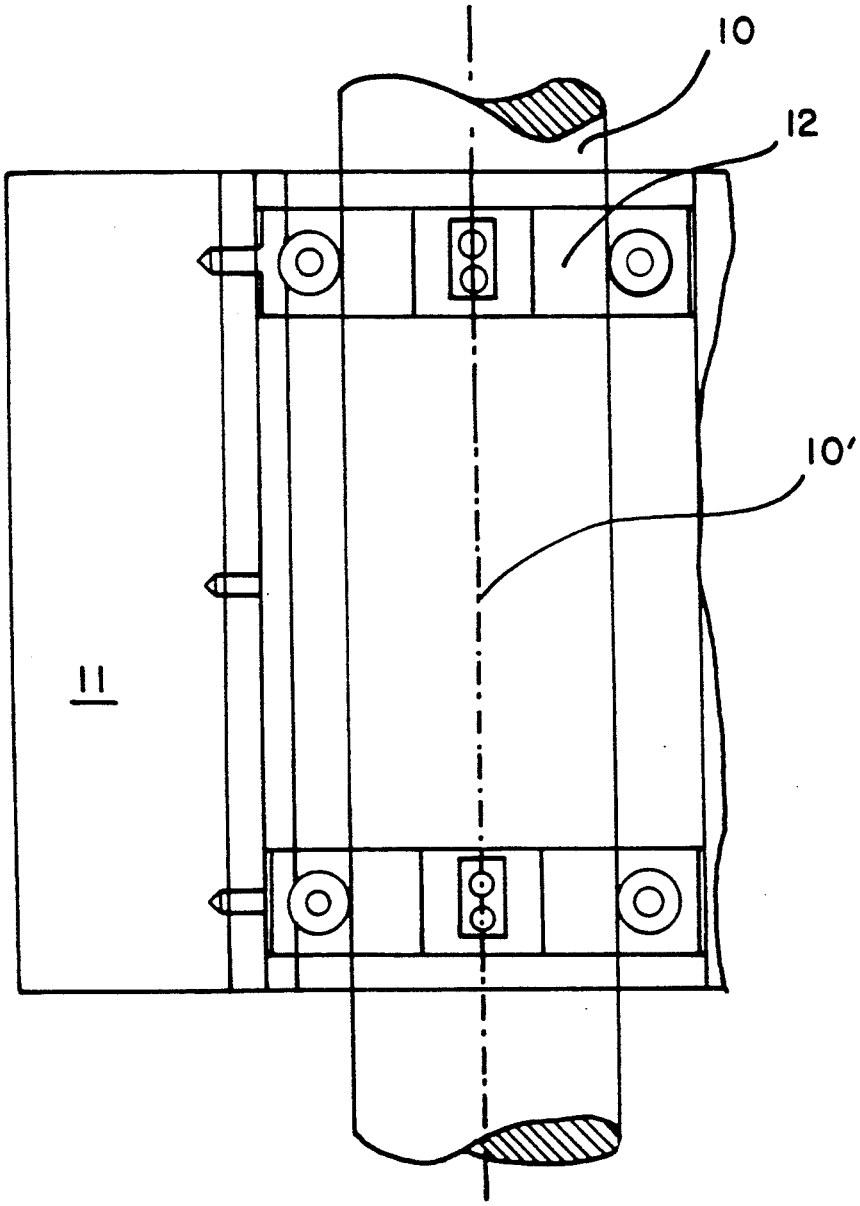
FIG. 3 is a top view of the counterpressure surface of the feed drum.

To accomplish the constant pressure at the first nip 7, in the preferred embodiment the feed drum 2 includes a counterpressure section 11 mounted on a shaft 10, preferably by a pair of tensioning means 12. The preferred tensioning means 12 are dimensioned to facilitate the bolting of the counterpressure section 11 against the shaft. So that conventional chain-guided gripper means 21 can be accommodated, the counterpressure section 11 of the feed drum 2 only partially surrounds the shaft 1, thus defining a clearance 13 extending parallel to the axis 10' of the shaft (see FIG. 3).

Disposed at each end of the counterpressure section 11 are clamping devices 15 for securing the counterpressure surface 20 (such as a rubber blanket) around the periphery of the counterpressure section 11. By thickening the counterpressure surface 20 or by further adding underlaying sheets or the like beneath the counterpressure surface 20, the diameter of the counterpressure surface 20 can be increased. Accordingly, the pressing force of the feed drum 2 can be varied as necessary for achieving a predetermined optimal printing pressure to adjust for sheets having varying thicknesses and other qualities. It should be noted that the diameter of the varnishing blanket 30 on the varnishing cylinder 1 can be expanded in a like manner for the predetermined control of the amount of contact pressure with the impression cylinder 3.

Although not necessary to the invention, to reduce weight and to compensate for other imbalances, particularly the imbalance resulting from the clearance 13, the counterpressure section 11 may be further provided with a number of cavities 9.

Additionally, depending on the printing order, the counterpressure section 11 is designed to be displaceable along the shaft 10 by releasing the tensioning means 12. To ensure that the clearance 13 remains in proper alignment to accommodate the gripper means 21, guide means 14 are provided. For example, one such guide means 14 comprises a pin 14' or the like protruding from the inner diameter of the counterpressure section 11 arranged to engage and slide along a groove cut into the outer surface of the shaft 10, the groove extending substantially over the length of the shaft 10, i.e., parallel to the axis 10' of the shaft 10.

In operation, as sheets 6 are transferred to the impression cylinder 3 from the feed drum 2, the counterpressure section 11 incorporated in the feed drum 2 rotates to form a first nip 7 between its counterpressure surface 20 and the impression cylinder 3 where the sheet 6 is carried therethrough. The pressure at the first nip 7 created by counterpressure section 11 generates a constant pressure to effect an even transfer of the ink from the previously inked impression cylinder 3 to the verso side of the sheet.

Soon thereafter, the sheet 6 reaches a second nip 8 created by the varnishing cylinder 1 (at varnishing blanket 30) and the impression cylinder 3. Varnish is thereby applied in a conventional manner to the recto printing side of the sheet 6. Thus, regardless of whether the pressure varies at the second nip 8, for example due to intervals within the varnishing blanket 30 arranged for partial or intermittent varnishing, the print quality remains consistent since an even pressure at the first nip 7 has already consistently transferred the ink to the verso side of the sheet 6. Finally, once the sheets (such as the sheet 6) are transported through the second nip 8, the sheets are removed from the impression cylinder in a conventional manner by means such as a delivery transport system 16.

It will be understood by one skilled in the art that a plurality of counterpressure sections 11 having equal diameters may be arranged in axially displaceable relation to each other along the shaft 10 such that the sections are adjustable in dependence on the printing order. It will further be understood that a run-on contour may be provided on the outer surface of the counterpressure section 11 at each end, i.e., near the clearance 13. This contour might be in the form of a radial elevation, for example a ridge, or a radial depression, for example a groove, extending parallel to the axis of the shaft 10. In either case, jolts or vibrations resulting from the counterpressure section 11 coming into contact with the impression cylinder 3 (as the clearance 13 is rotated away) can be reduced.

As can be seen from the foregoing, a method and apparatus has been provided for consistently printing a verso sheet side and varnishing a printed recto sheet side. Because the invention provides a constant pressure during printing of the verso side of the sheet prior to varnishing, the ink is consistently transferred to the verso side of the sheet independent of the application of varnish to the printed recto side. Accordingly, the print quality is consistent even when only partially or intermittently varnishing the recto side. Finally, the printing on a verso side occurs prior to varnishing the recto side, however the entire operation is performed without removing the sheet from the impression cylinder to a separate varnishing unit.

What is claimed is:

1. An apparatus for printing to a verso printing side of a sheet on an impression cylinder and subsequently varnishing a recto printing side of the sheet while the sheet is on the impression cylinder, comprising:

an inking unit for providing ink to the impression cylinder;

a feed drum for feeding the sheet to the impression cylinder;

a counterpressure device in pressure contact with the impression cylinder forming a first nip through which sheets are transported, wherein the pressure provided by the counterpressure surface causes ink to be transferred from the impression cylinder onto the verso side of the sheet; and a varnishing unit including a varnishing cylinder in pressure contact with the impression cylinder forming a second nip through which sheets are transported after being transported through the first nip, wherein the pressure provided by the varnishing cylinder causes varnish to be transferred from the varnishing cylinder onto the recto side of the sheet.

2. The apparatus of claim 1 further comprising means for removing the sheet from the impression cylinder following passage of the sheet through said second nip.

3. The apparatus of claim 1 wherein the counterpressure device is incorporated within the feed drum.

4. The apparatus of claim 3 in which said feed drum is mounted on a rotatable shaft.

5. The apparatus of claim 4 wherein the impression cylinder includes at least one gripper means, and the counterpressure device within the feed drum defines a clearance opening for accommodating the gripper means during feeding of sheets to the impression cylinder.

6. The apparatus of claim 5 wherein the feed drum and incorporated counterpressure device is axially displaceable along said shaft.

7. The apparatus of claim 6 further comprising a guide means for maintaining predetermined alignment of said counterpressure device on said shaft.

8. The apparatus of claim 7 wherein the guide means includes a protrusion on the counterpressure device arranged to engage and slide along a groove cut in the outer surface of the shaft.

9. The apparatus of claim 6 wherein the counterpressure device is mounted on said shaft by adjustable tensioning means such that the counterpressure device is made displaceable relative to said shaft upon an adjustment of the tensioning means.

10. The apparatus of claim 4 wherein the counterpressure device includes a detachable counterpressure surface.

11. The apparatus of claim 10 wherein the diameter of the detachable counterpressure surface is variable, and the amount of pressure between the counterpressure device and the impression cylinder corresponds to the diameter of the counterpressure surface.

12. The apparatus of claim i wherein the pressure provided by the counterpressure device on the impression cylinder is essentially constant as sheets are transported through said first nip.

13. The apparatus of claim 1 wherein the pressure provided by the varnishing cylinder on the impression cylinder varies as sheets are transported through said second nip.

14. The apparatus of claim 1 wherein the inking unit includes a plate cylinder.

15. A method of printing and varnishing sheets in a printing machine having a rotatable impression cylinder, a feed drum for transferring sheets to the impression cylinder and including a counterpressure section in pressure contact with the impression cylinder forming a first nip through which sheets must pass, and a rotatable varnishing cylinder in pressure contact with said impression cylinder forming a second nip through which sheets must pass, comprising the steps of:

supplying ink to the impression cylinder;

supplying varnish to the varnishing cylinder;

feeding successive sheets to said impression cylinder;

transporting the sheets on the impression cylinder through the first nip such that ink is transferred from the impression cylinder to a verso side of the sheets;

carrying sheets on the impression cylinder through the second nip such that varnish is transferred from the varnishing cylinder to the recto side of the sheets at a later time than the transferring of ink to the verso side; and transferring sheets away from said impression cylinder.

16. The method of claim 15 wherein the impression cylinder is in pressure contact with a rotatable plate cylinder for transferring ink to said impression cylinder, and the step of supplying ink to the impression cylinder comprises the steps of supplying ink to the plate cylinder, and transferring ink from the plate cylinder to the impression cylinder.

17. The method of claim 15 further comprising the step of printing the recto side of the sheet before feeding the sheet to the impression cylinder.

18. The method of claim 15 wherein the impression cylinder has a plate secured thereto, and the step of supplying ink to the impression cylinder includes transferring ink to the plate.

19. The method of claim 15 wherein the impression cylinder includes a blanket secured thereto, and the step of supplying ink to the impression cylinder includes transferring ink to the blanket.

* * * * *